US008434561B2

(12) United States Patent
Bullock et al.

(10) Patent No.: US 8,434,561 B2
(45) Date of Patent: May 7, 2013

(54) CONTROLLED HYDROSTATIC PRESSURE COMPLETION SYSTEM

(75) Inventors: Raymond R. Bullock, Hoveton (GB); Andrew D. Penno, Morlaas (FR)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/331,952

(22) Filed: Dec. 20, 2011

(65) Prior Publication Data

US 2012/0175113 A1 Jul. 12, 2012

(30) Foreign Application Priority Data

Jan. 10, 2011 (WO) ..... PCT/US2011/020704

(51) Int. Cl.
*E21B 23/00* (2006.01)

(52) U.S. Cl.
USPC ..... 166/381; 166/281; 166/229; 166/208; 175/22; 175/314

(58) Field of Classification Search ..... 166/206–217, 166/179–203, 227–236, 281, 381; 175/57, 175/22, 314
See application file for complete search history.

(56) References Cited

U.S. PATENT DOCUMENTS

| | | | | |
|---|---|---|---|---|
| 4,194,567 | A | 3/1980 | Marais | |
| 5,865,251 | A | 2/1999 | Rebardi et al. | |
| 6,302,208 | B1 | 10/2001 | Walker et al. | |
| 6,354,378 | B1 | 3/2002 | Patel | |
| 6,745,834 | B2 | 6/2004 | Davis et al. | |
| 6,766,862 | B2 | 7/2004 | Chatterji et al. | |
| 6,799,645 | B2 * | 10/2004 | Mason et al. | 175/57 |
| 7,108,083 | B2 * | 9/2006 | Simonds et al. | 175/57 |
| 7,188,687 | B2 | 3/2007 | Rudd et al. | |
| 7,234,542 | B2 | 6/2007 | Vail, III | |
| 7,243,742 | B2 | 7/2007 | Kutryk | |
| 7,708,076 | B2 | 5/2010 | Richard et al. | |
| 7,757,762 | B2 | 7/2010 | O'Malley | |
| 7,784,552 | B2 | 8/2010 | Brouse | |
| 2003/0183395 | A1 | 10/2003 | Jones | |
| 2005/0077086 | A1 * | 4/2005 | Vise, Jr. | 175/59 |
| 2009/0173543 | A1 * | 7/2009 | Zupanick | 175/57 |
| 2009/0200085 | A1 * | 8/2009 | Williams | 175/71 |

FOREIGN PATENT DOCUMENTS

| | | | |
|---|---|---|---|
| RU | 2266391 | C1 | 12/2005 |
| RU | 89872 | U1 | 12/2009 |

OTHER PUBLICATIONS

Search Report issued Sep. 7, 2011 for International Application No. PCT/US11/20704, 5 pages.
Written Opinion issued Sep. 7, 2011 for International Application No. PCT/US11/20704, 3 pages.

(Continued)

*Primary Examiner* — David Bagnell
*Assistant Examiner* — Ronald Runyan
(74) *Attorney, Agent, or Firm* — Smith IP Services, P.C.

(57) ABSTRACT

A method of drilling and completing a well can include drilling a section of a wellbore, positioning a perforated shroud in the section of the wellbore, securing the perforated shroud by setting a hanger, and isolating the section of the wellbore from a remainder of the wellbore vertically above the section of the wellbore. The drilling, positioning, securing and isolating steps can be performed while the section of the wellbore is not exposed to a liquid column extending to a surface location. The drilling, positioning, securing and isolating steps can be performed in a single trip of a drill string into the wellbore.

21 Claims, 6 Drawing Sheets

OTHER PUBLICATIONS
Halliburton; "Advances in Sand Control", company presentation, 15 pages.
Halliburton; "FS2 Fluid Loss Isolation Barrier Valve", H07007, dated May 2012, 2 pages.
Tesco; "Tesco Casing Drilling", company brochure, dated Apr. 2008, 12 pages.
Halliburton; "VersaFlex Liner Hanger System", product presentation, dated Jan. 26, 2010, 20 pages.
Weatherford; "Drilling-with-Liner (DwL) System", product brochure 6140.00, dated 2010, 12 pages.

* cited by examiner

CONTROLLED HYDROSTATIC PRESSURE COMPLETION SYSTEM

CROSS-REFERENCE TO RELATED APPLICATION

This application claims the benefit under 35 USC §119 of the filing date of International Application Serial No. PCT/US11/20704, filed 10 Jan. 2011. The entire disclosure of this prior application is incorporated herein by this reference.

BACKGROUND

The present disclosure relates generally to equipment utilized and operations performed in conjunction with a subterranean well and, in an embodiment described herein, more particularly provides a controlled hydrostatic pressure completion system.

To prevent damage to a reservoir penetrated by a wellbore, to prevent unacceptable fluid loss to the reservoir, and to prevent excessive fluid influx from the reservoir, techniques have been developed to accurately control wellbore pressures. For example, in managed pressure drilling or optimized pressure drilling, the wellbore can be closed off from the atmosphere to enable closed-loop control of wellbore pressures via regulation of rig pump pressure, return flow through a choke manifold, a dual density fluid column, etc.

Therefore it will be appreciated that it would be beneficial to provide for a controlled hydrostatic pressure completion system.

DETAILED DESCRIPTION

Figure 1:
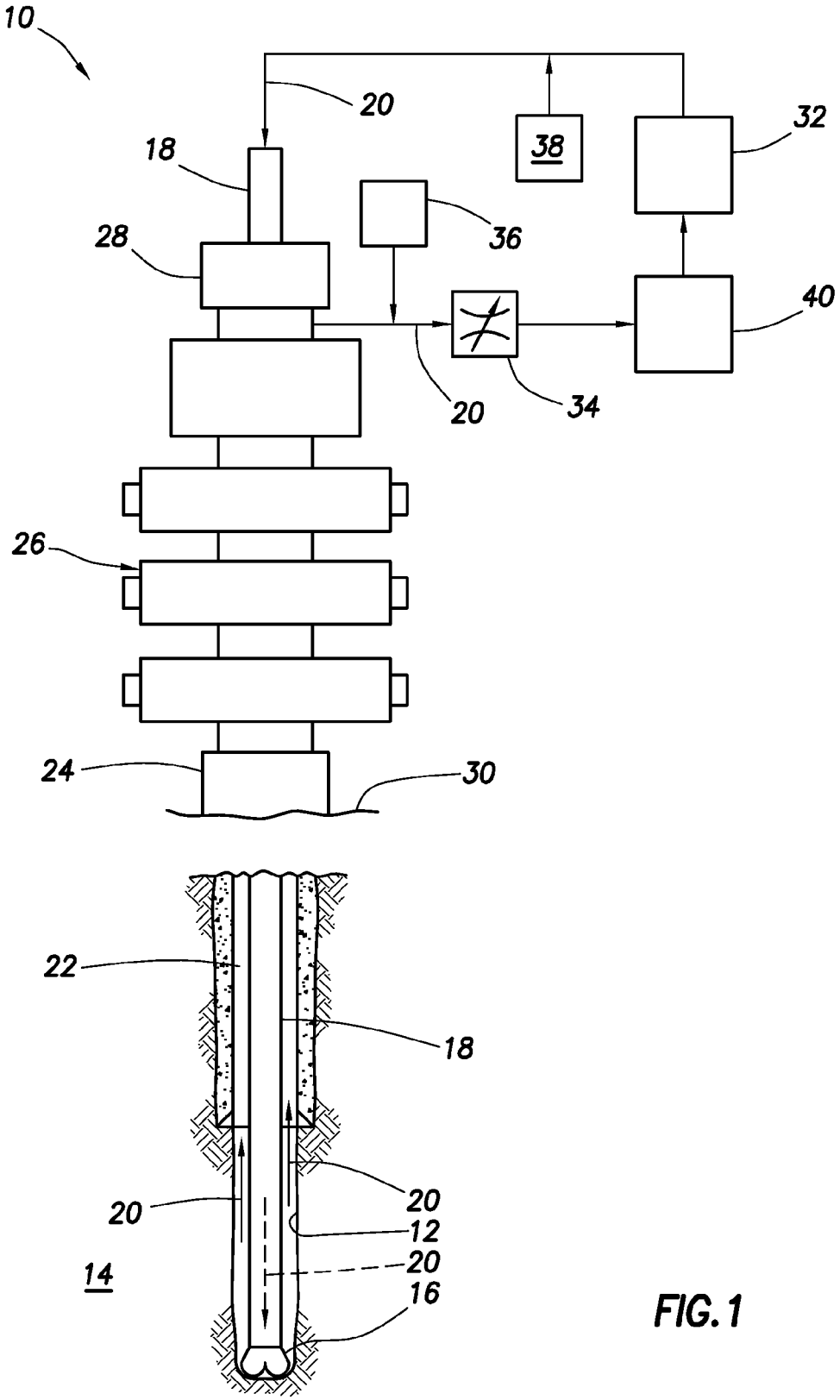
FIG. 1 is a representative partially cross-sectional view of a well system and associated method which can embody principles of the present disclosure.

Representatively illustrated in FIG. 1 is a well system 10 and associated method which can embody principles of the present disclosure. In the method, a wellbore 12 is drilled into an earth formation 14 comprising a reservoir, for example, of hydrocarbon fluid. In other examples, the well system 10 could comprise a geothermal well, an injection well, or another type of well. Thus, it should be understood that it is not necessary for the well to be used for production of hydrocarbon fluid.

The wellbore 12 is drilled by rotating a drill bit 16 on a downhole end of a generally tubular drill string 18. Drilling fluid 20 is circulated through the drill string 18 and an annulus 22 surrounding the drill string during the drilling operation.

In the FIG. 1 example, the drill string 18 extends through a wellhead 24, a blowout preventer stack 26 and a rotating control device 28 at a surface location 30. The rotating control device 28 (also known as a rotating blowout preventer, a rotating control head, a rotating diverter, etc.) seals off the annulus 22 about the drill string 18 while the drill string rotates. In other examples, the drill string 18 may not rotate during drilling (such as, examples in which a drilling motor is used to rotate the drill bit 16).

The surface location 30 could be at a land-based drilling rig, an offshore drilling rig, a jack-up drilling rig, a subsea mud line, etc. For the purposes of this disclosure, the earth's surface, whether or not covered by water, is considered a surface location.

During drilling, an open hole (uncased) section of the wellbore 12 is exposed to hydrostatic pressure in the wellbore due to a weight of the drilling fluid 20, fluid friction due to flow of the fluid through the annulus 22, pressure applied by a rig pump 32, and backpressure due to restriction to flow of the drilling fluid through a choke manifold 34. These influences on the pressure in the wellbore 12 can be controlled using techniques known to those skilled in the art as managed, optimized, underbalanced, at balance, etc., drilling.

A fluid conditioning facility 40 can separate gas and solids from the drilling fluid 20, and otherwise condition the fluid as it is circulated from the choke manifold 34 to the rig pump 32. In this example, the fluid conditioning facility 40 comprises the rig's mud system, e.g., including a degasser, shale shakers, mud tanks, mixing tanks, etc. The density of the drilling fluid 20 can be varied as needed in the facility 40, to thereby change the hydrostatic pressure exerted by the drilling fluid in the wellbore 12.

If desired, pressure can be added to the drilling fluid 20 by means of a backpressure or makeup pump 36, fluid can be diverted from the drill string 18 to the choke manifold 34 during cessation of drilling fluid flow through the drill string (such as, while making connections in the drill string, etc.), and the hydrostatic pressure of the drilling fluid can be decreased by adding a relatively low density fluid 38 (such as nitrogen gas, gas-filled glass spheres, etc.) to the drilling fluid before or after the drilling fluid is pumped through the drill string 18.

By using these techniques and others, pressure in the wellbore 12 section directly exposed to the formation 14 can be maintained greater than, equal to, and/or less than pore pressure of the formation in that section of the wellbore. In different circumstances, it may be desired to drill into the formation 14 while pressure in the exposed section of the wellbore 12 is maintained overbalanced, underbalanced or balanced with respect to pore pressure in the formation.

Referring additionally now to FIGS. 2-9, a series of steps in a method 44 of drilling and completing the wellbore 12 are representatively illustrated. The method 44 can be practiced with the well system 10 depicted in FIG. 1, but its practice is not limited to the FIG. 1 well system.

Figure 2:
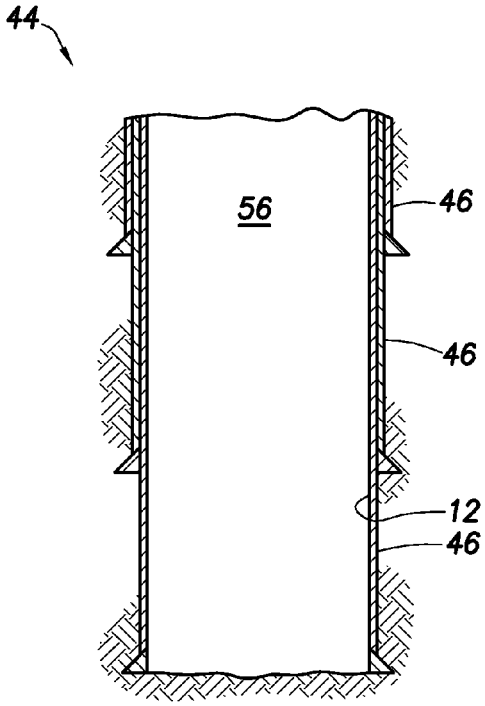
FIGS. 2-9 are representative illustrations of a sequence of steps in the method.

FIG. 2 illustrates that, in this example, the wellbore 12 has been drilled and cased to a depth approaching a desired open hole completion location. As depicted in FIG. 2, several casing strings 46 have been installed and cemented, with a lowermost one of these being a production casing. FIG. 2 also illustrates that, in this example, the wellbore 12 can contain a fluid column 56.

Figure 3:
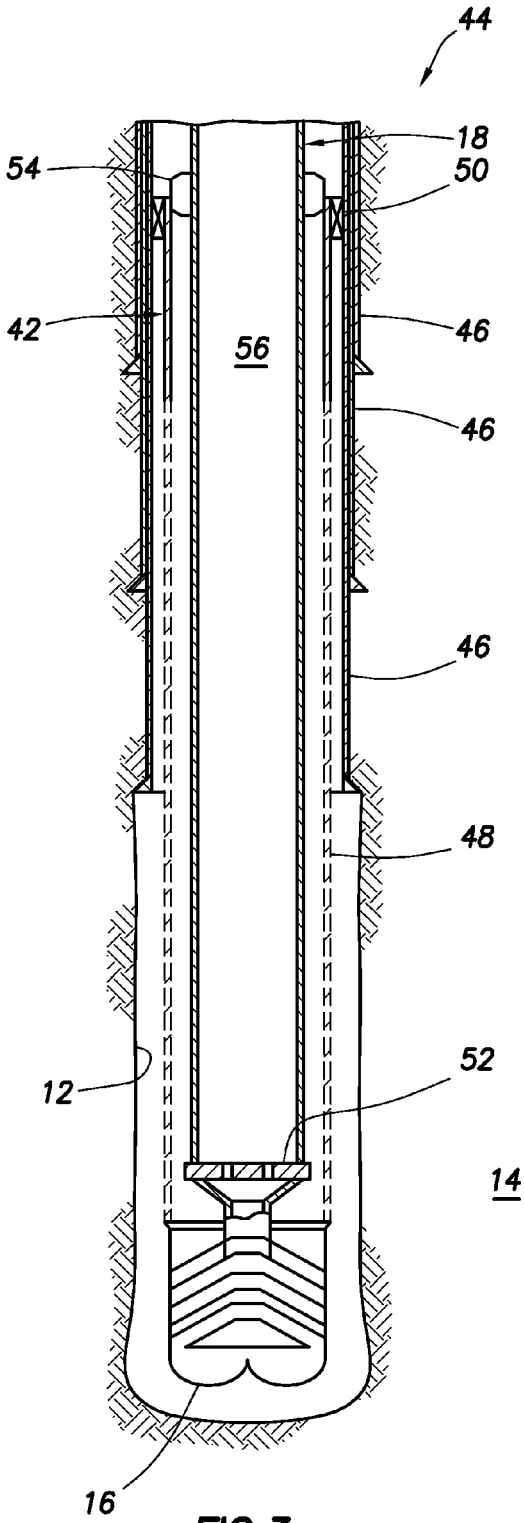

In FIG. 3, the drill string 18 is used to extend the wellbore 12 into the formation 14. A liner string 42 has the drill bit 16 connected below a perforated shroud 48 and an expandable liner hanger 50. The drill string 18 is releasably connected to the expandable liner hanger 50 with a service tool 54. The perforated shroud 48 is connected between the hanger 50 and the drill bit 16. The fluid column 56 surrounds the liner string 42 and drill bit 16.

A suitable perforated shroud for use as the shroud 48 is the CAPS™ shroud marketed by Halliburton Energy Services, Inc. of Houston, Tex. USA. The shroud 48 could be another type of perforated liner in other examples. As used herein, the term "perforated shroud" includes perforated liners, slotted liners, well screen shrouds and similar equipment.

As the drill string 18 rotates, the drill bit 16, shroud 48 and liner hanger 50 also rotate, and the drill bit penetrates the formation 14. Alternatively, or in addition, the drill bit 16 (but not the shroud 48 and liner hanger 50) may be rotated by use of a conventional mud motor (not shown) interconnected in the drill string 18 above the drill bit. Eventually, a desired total depth of the wellbore 12 is reached.

Figure 4:
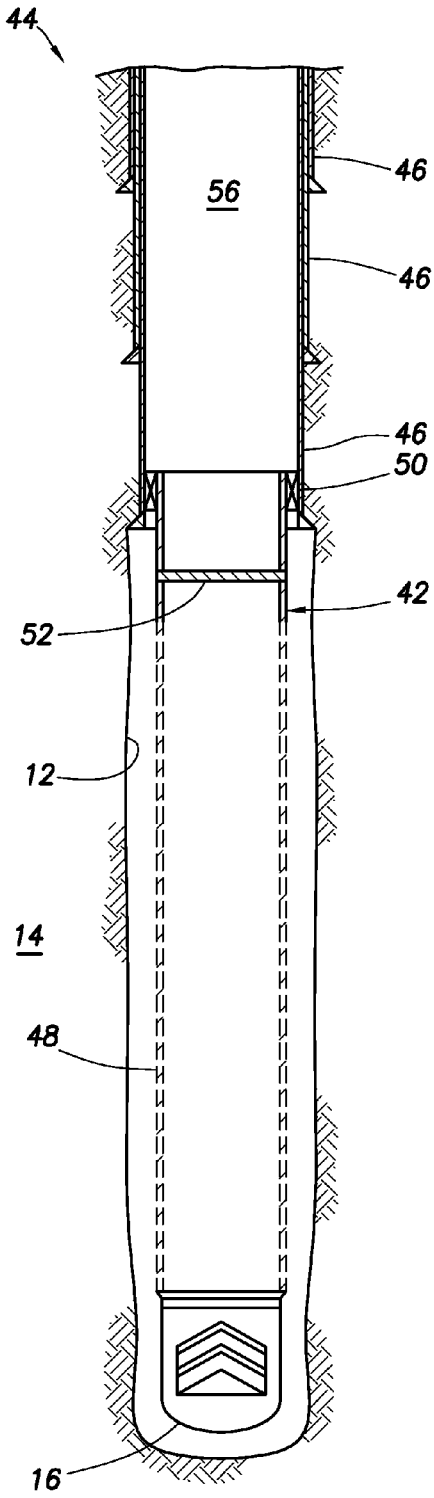

In FIG. 4, the liner hanger 50 has been set in the production casing string 46, thereby securing the shroud 48 in the section of the wellbore 12 directly exposed to the formation 14. The hanger 50 is preferably set by expanding it outward into gripping and sealing contact with the casing string 46. A VERSAFLEX™ expandable liner hanger marketed by Halliburton Energy Services, Inc. is expanded by driving a conical wedge through a tubular mandrel to outwardly deform the mandrel, but other types of liner hangers or packers, and other ways of expanding hangers, may be used in other examples.

Note that a plug 52 is set in the liner string 42, preferably using the drill string 18 as it is being withdrawn from the wellbore 12. The plug 52 can be latched into a suitable profile in the liner string 42, can be set by application of pressure, force, etc., or otherwise sealingly engaged in the liner string. This plug 52 isolates the section of the wellbore 12 directly exposed to the formation 14 from hydrostatic pressure due to the fluid column 56 vertically above that section of the wellbore.

Note, also, that the wellbore 12 in this example has been drilled into the formation 14, the shroud 48 has been positioned in the open hole section of the wellbore, the liner string 42 has been secured by setting the hanger 50, and the plug 52 has been set in the liner string, without exposing the formation to hydrostatic pressure of a full liquid column, and in only a single trip of the drill string 18 into the wellbore.

The formation 14 is not exposed to hydrostatic pressure of a full liquid column, because while the wellbore 12 is being drilled with the liner string 42, two-phase drilling fluid 20 is circulated through the drill string 18 (e.g., with low density fluid, such as nitrogen gas, being added to the drilling fluid), so that the drilling fluid comprises both liquid and gas. After the plug 52 is set (e.g., by latching the plug into a suitable profile in the liner string 42), the fluid column 56 might comprise a full liquid column extending to the surface location 30, but the plug will isolate that liquid column from the formation 14.

Separate trips of the drill string 18 into the wellbore 12 are not needed to separately drill the wellbore into the formation 14, run the liner string 42 and set the liner hanger 50, set the plug 52, etc. Wellbore pressure control is simplified, and less time and expense are required, if the number of trips into the wellbore 12 can be minimized.

Figure 5:
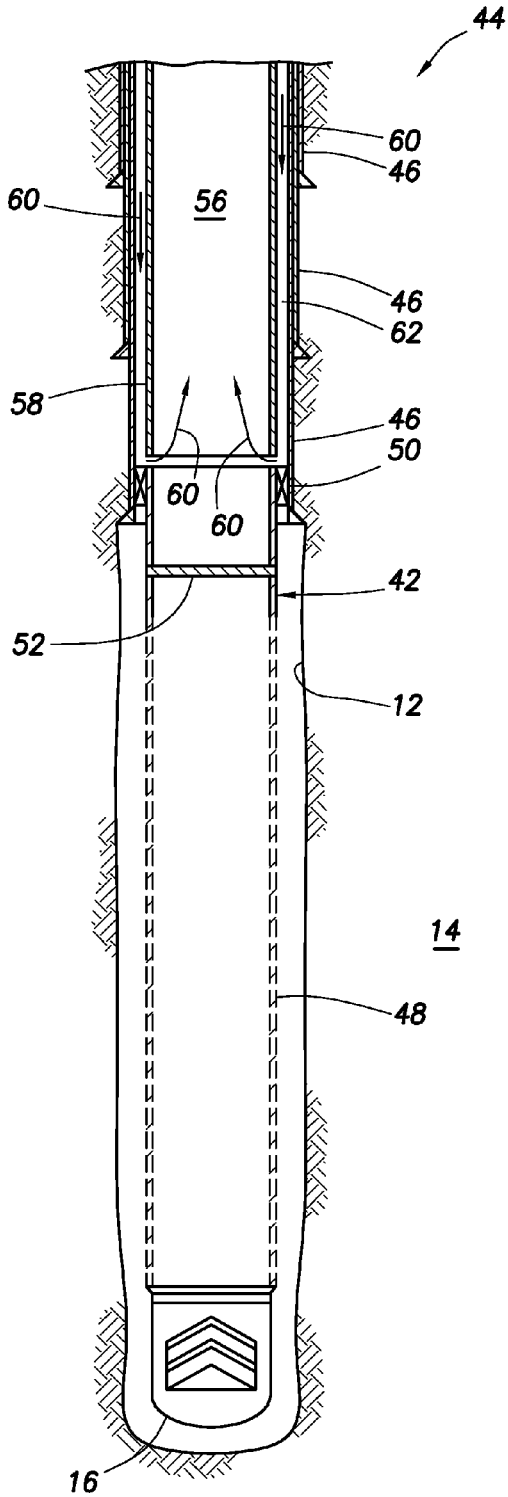

In FIG. 5, an injection liner 58 is installed in the production casing string 46. This permits a gas 60 (such as nitrogen) to be injected into the wellbore 12 via an annular space 62 formed radially between the injection liner 58 and the production casing string 46. If dimensions permit, the injection liner 58 can be installed prior to drilling the open hole section of the wellbore 12.

The gas 60 reduces the density of the fluid column 56, thereby providing a means of controlling hydrostatic pressure in the wellbore 12. More or less gas 60 can be flowed via the annular space 62 to respectively decrease or increase the hydrostatic pressure exerted by the fluid column 56.

Figure 6:
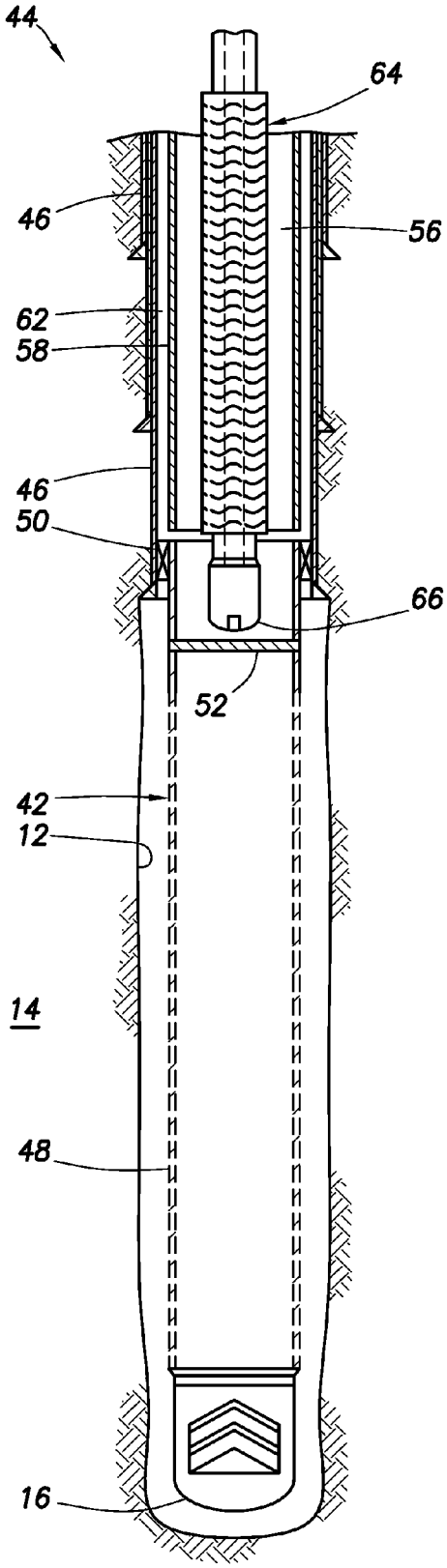

In FIG. 6, a sand control assembly 64 is installed in the wellbore 12. In this example, the sand control assembly 64 includes a plug release tool 66 which can engage and release the plug 52 to then allow the open hole section of the wellbore 12 to be exposed again to the fluid column 56 above the liner string 42.

Figure 7:
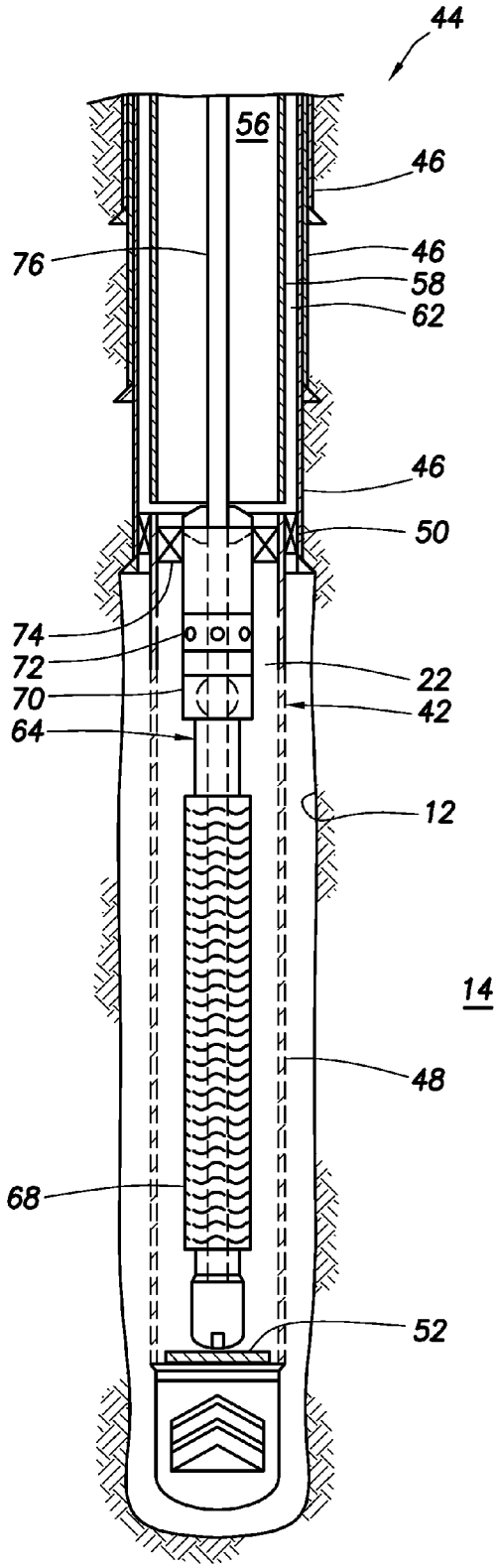

As depicted in FIG. 7, the sand control assembly 64 is fully installed. In this example, the sand control assembly 64 includes a well screen 68, an isolation valve 70, a crossover 72 and a gravel pack packer 74. These components are well known to those skilled in the art, and so are not further described herein.

A suitable valve for use as the isolation valve 70 is the FS-2 Fluid Loss Device marketed by Halliburton Energy Services, Inc. A suitable packer for use as the gravel pack packer is the VERSA-TRIEVE™, also marketed by Halliburton Energy Services, Inc. However, other types of isolation valves, fluid loss control devices and packers may be used in keeping with the principles of this disclosure.

The sand control assembly 64 is conveyed into the wellbore 12 by a work string 76. The packer 74 is set in the liner string 42, thereby securing and sealing the sand control assembly 64 in the liner string.

The open hole section of the wellbore 12 can optionally be gravel packed by flowing a gravel slurry through the work string 76, and outward via the crossover 72 into the annulus 22. However, it is not necessary to gravel pack the open hole section of the wellbore 12 in keeping with the principles of this disclosure.

If the wellbore 12 is gravel packed, gravel 78 (not shown in FIG. 7, see FIGS. 8 & 9) will accumulate about the well screen 68, and both inside and outside the shroud 48. The fluid portion of the gravel slurry flows into the screen 68, upward through the crossover 72 and into the annulus 22 above the packer 74. The fluid portion is lightened by nitrogen gas 60 (or another fluid less dense as compared to the fluid portion) flowed into the fluid column 56 via an annulus formed radially between the injection liner 58 and the casing string 46. This prevents the formation 14 from being exposed to a full liquid column hydrostatic pressure throughout the gravel packing procedure. Of course, the wellbore 12 could be gravel packed using other techniques, if desired.

The work string 76 is then retrieved from the well. As the work string 76 is withdrawn from the sand control assembly 64, the isolation valve 70 is closed, thereby again isolating the now gravel packed section of the wellbore 12 while the injection liner 58 is retrieved from the well and an upper completion string 80 is installed. During this process, a filter cake treatment may be applied, if desired.

Figure 8:
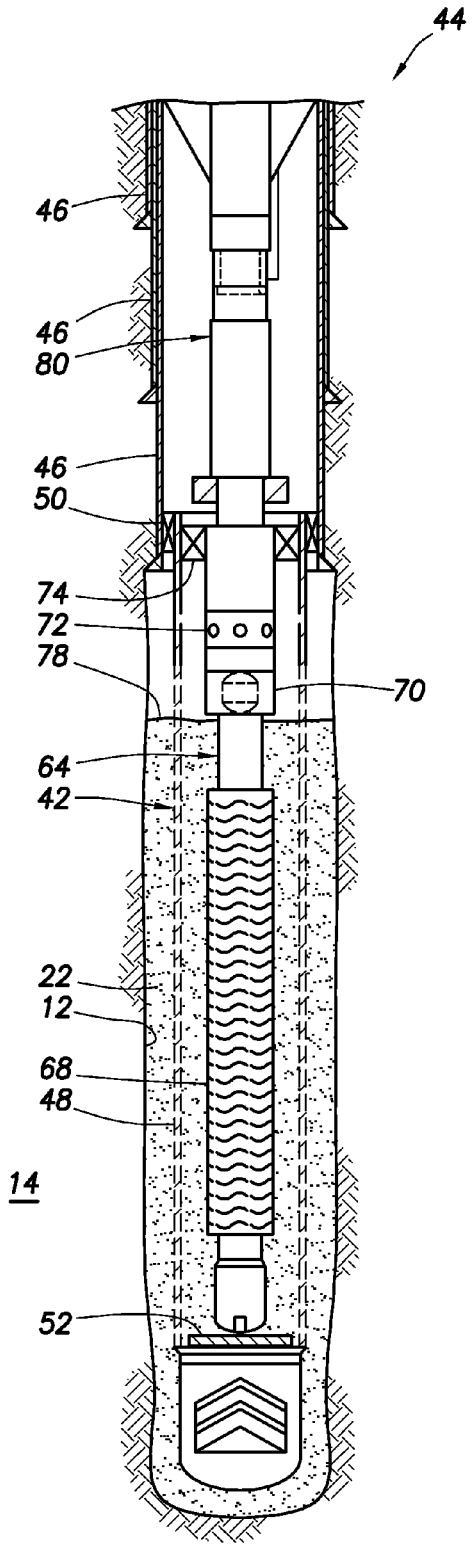
Figure 9:
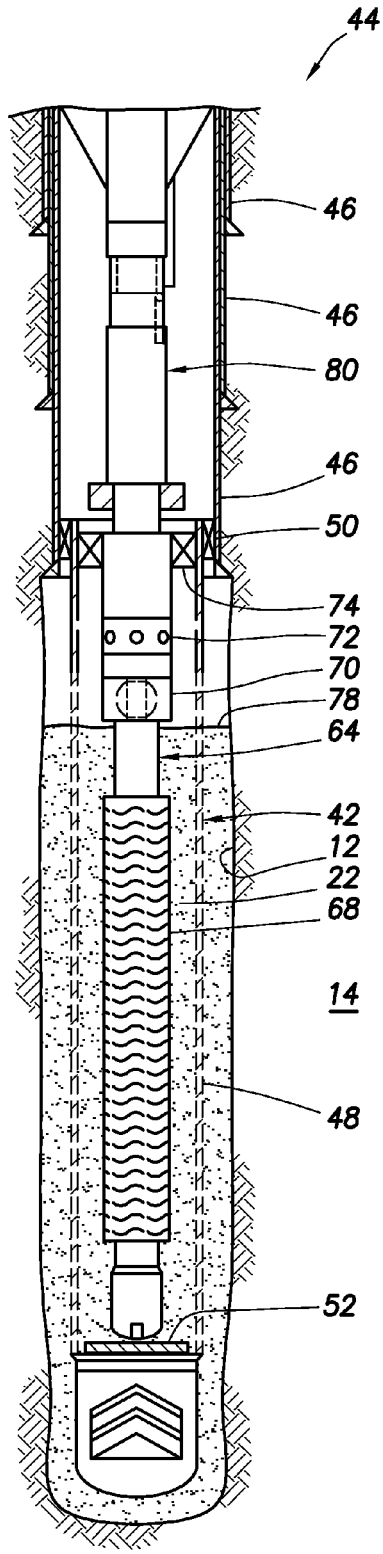

In FIG. 8, the completion string 80 is being installed while the isolation valve 70 remains closed. In FIG. 9, the completion string 80 is fully installed, the isolation valve 70 is opened (e.g., in response to engagement between the completion string and the sand control assembly 64, application of a predetermined series of pressure manipulations, etc.), and the system is ready for production of fluid from the formation 14.

Figure 12:
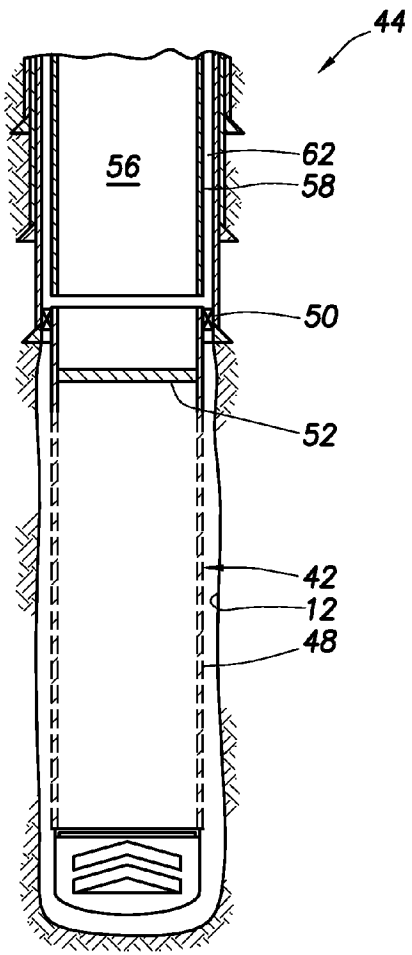
FIGS. 10-12 are representative illustrations of an alternate sequence of steps in the method.
Figure 11:
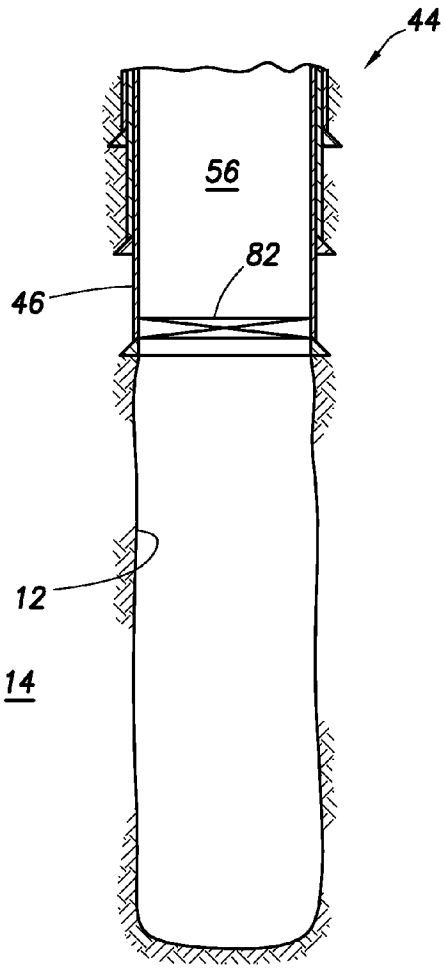
Figure 10:
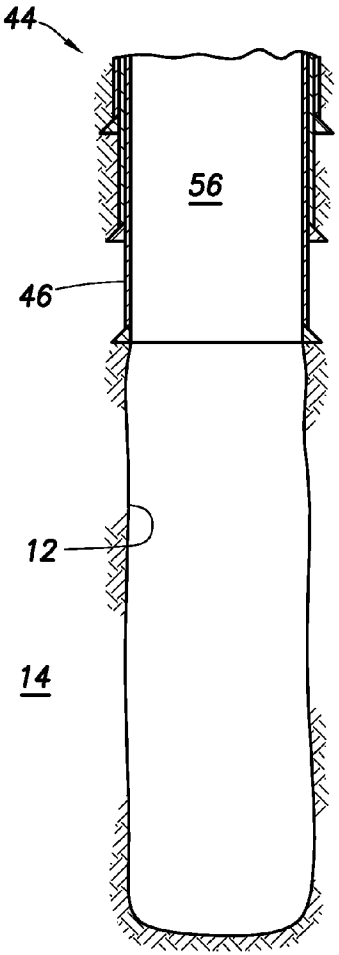

FIGS. 10-12 depict an alternate series of steps in the method 44. The steps of FIGS. 10-12 can be substituted for the steps of FIGS. 3-5. Instead of drilling into the formation 14 with the liner string 42 connected at an end of the drill string 18, the steps of FIGS. 10-12 begin with the wellbore 12 being drilled into the formation 14 without the liner string.

In FIG. 10, the wellbore 12 has been drilled with the drill bit 16 on the end of the drill string 18 (as depicted in FIG. 1), but without the liner string 42. Thus, there is no liner string 42 in the open hole section of the wellbore 12 when it is drilled.

In FIG. 11, a plug 82 is set in the production casing string 46 after the open hole section of the wellbore 12 has been drilled. The plug 82 isolates the open hole section of the wellbore 12 from the fluid column 56 vertically above the plug.

In FIG. 12, the plug 82 has been drilled through or otherwise removed, and the liner string 42 is installed in the open hole section of the wellbore 12. The plug 82 can be drilled through, released, unset, etc., by the liner string 42 when it is installed.

This alternate version of the method 44 now proceeds to the step depicted in FIG. 6, wherein the sand control assembly 64 is installed in the liner string 42.

Although specific examples of equipment, components, elements, etc. of the well system 10 are described above, and specific steps and techniques are described above for certain examples of the method 44, it should be clearly understood that this disclosure is not limited to only these specific examples. Many variations of well systems and methods may be practiced using the principles of this disclosure.

In one example, this disclosure describes a method 44 of drilling and completing a well. The method 44 can include performing the following steps a)-d) in a single trip of a drill string 18 into a wellbore 12:

a) drilling a section of the wellbore 12;

b) positioning a perforated shroud 48 in the section of the wellbore 12;

c) securing the perforated shroud 48 by setting a hanger 50; and d) isolating the section of the wellbore 12 from a remainder of the wellbore 12 vertically above the section of the wellbore 12.

Steps a)-d) are preferably performed while the section of the wellbore 12 is not exposed to a liquid column extending to a surface location 30.

Steps a)-d) can be performed while the section of the wellbore 12 is exposed to a two-phase fluid column 56.

Setting the hanger 50 can include expanding the hanger 50.

Isolating the section of the wellbore 12 can involve setting a plug 52 in a liner string 42 which includes the hanger 50 and the perforated shroud 48.

The method 44 may include gravel packing the section of the wellbore 12. The gravel packing step can include unsetting the plug 52, positioning a sand control assembly 64 in the liner string 42, and flowing a gravel 78 slurry into an annulus 22 between the sand control assembly 64 and the section of the wellbore 12. The gravel packing can be performed in a single trip of a work string 76 into the wellbore 12.

The method 44 can include installing an injection liner 58 in a casing string 46, and flowing a gas 60 into the casing string 46 through an annular space 62 between the injection liner 58 and the casing string 46. Installing the injection liner 58 can be performed after isolating the open hole section of the wellbore 12 and prior to gravel packing the open hole section of the wellbore 12. Installing the injection liner 58 can be performed prior to drilling the open hole section of the wellbore 12.

Drilling the open hole section of the wellbore 12 can include rotating a drill bit 16 connected to the perforated shroud 48.

A method 44 of drilling and completing a well can include: drilling a section of a wellbore 12; positioning a perforated shroud 48 in the section of the wellbore 12; securing the perforated shroud 48 by setting a hanger 50; and isolating the section of the wellbore 12 from a remainder of the wellbore 12 vertically above the section of the wellbore 12. The drilling, positioning, securing and isolating steps are performed while the section of the wellbore 12 is not exposed to a liquid column extending to a surface location 30.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of drilling and completing a well, the method comprising:

performing the following steps a)-e) in a single trip of a drill string into a wellbore:

a) drilling a section of the wellbore;

b) positioning a perforated shroud in the section of the wellbore;

c) securing the perforated shroud by setting a hanger;

d) withdrawing the drill string from the shroud; and e) then isolating the section of the wellbore from a remainder of the wellbore vertically above the section of the wellbore.

2. The method of claim 1, wherein steps a)-e) are performed while the section of the wellbore is exposed to a hydrostatic pressure which is less than a full liquid column extending to a surface location.

3. The method of claim 1, wherein steps a)-e) are performed while the section of the wellbore is exposed to a two-phase fluid column.

4. The method of claim 1, wherein setting the hanger further comprises expanding the hanger.

5. The method of claim 1, wherein isolating the section of the wellbore further comprises setting a plug in a liner string which includes the hanger and the perforated shroud.

6. The method of claim 5, further comprising gravel packing the section of the wellbore, the gravel packing step comprising: removing the plug, positioning a sand control assembly in the liner string, and flowing a gravel slurry into an annulus between the sand control assembly and the section of the wellbore.

7. The method of claim 6, wherein gravel packing the section of the wellbore is performed in a single trip of a work string into the wellbore.

8. The method of claim 6, further comprising installing an injection liner in a casing string, and flowing a gas into the casing string through an annular space between the injection liner and the casing string.

9. The method of claim 8, wherein installing the injection liner is performed after isolating the section of the wellbore and prior to gravel packing the section of the wellbore.

10. The method of claim 8, wherein installing the injection liner is performed prior to drilling the section of the wellbore.

11. The method of claim 1, wherein drilling the section of the wellbore further comprises rotating a drill bit connected to the perforated shroud.

12. A method of drilling and completing a well, the method comprising:

drilling a section of a wellbore;

positioning a perforated shroud in the section of the wellbore;

securing the perforated shroud by setting a hanger; and isolating the section of the wellbore from a remainder of the wellbore vertically above the section of the wellbore, and wherein the drilling, positioning, securing and isolating steps are performed while the section of the wellbore is not exposed to a substantially single phase liquid column extending to a surface location, and wherein the drilling, positioning, securing and isolating steps are performed in a single trip of a drill string into the wellbore.

13. The method of claim 12, wherein the drilling, positioning, securing and isolating steps are performed while the section of the wellbore is exposed to a two-phase fluid column.

14. The method of claim 12, wherein setting the hanger further comprises expanding the hanger.

15. A method of drilling and completing a well, the method comprising:

drilling a section of a wellbore;

positioning a perforated shroud in the section of the wellbore;

securing the perforated shroud by setting a hanger; and isolating the section of the wellbore from a remainder of the wellbore vertically above the section of the wellbore, wherein the drilling, positioning, securing and isolating steps are performed while the section of the wellbore is not exposed to a substantially single phase liquid column extending to a surface location, and wherein isolating the section of the wellbore further comprises setting a plug in a liner string which includes the hanger and the perforated shroud.

16. The method of claim 15, further comprising gravel packing the section of the wellbore, the gravel packing step comprising: unsetting the plug, positioning a sand control assembly in the liner string, and flowing a gravel slurry into an annulus between the sand control assembly and the section of the wellbore.

17. The method of claim 16, wherein gravel packing the section of the wellbore is performed in a single trip of a work string into the wellbore.

18. The method of claim 16, further comprising installing an injection liner in a casing string, and flowing a gas into the casing string through an annular space between the injection liner and the casing string.

19. The method of claim 18, wherein installing the injection liner is performed after isolating the section of the wellbore and prior to gravel packing the section of the wellbore.

20. The method of claim 18, wherein installing the injection liner is performed prior to drilling the section of the wellbore.

21. A method of drilling and completing a well, the method comprising:

drilling a section of a wellbore;

positioning a perforated shroud in the section of the wellbore;

securing the perforated shroud by setting a hanger; and isolating the section of the wellbore from a remainder of the wellbore vertically above the section of the wellbore, wherein the drilling, positioning, securing and isolating steps are performed while the section of the wellbore is not exposed to a substantially single phase liquid column extending to a surface location, and wherein drilling the section of the wellbore further comprises rotating a drill bit connected to the perforated shroud.

* * * * *